US007614143B2

(12) United States Patent
Seff et al.

(10) Patent No.: US 7,614,143 B2
(45) Date of Patent: Nov. 10, 2009

(54) METHOD OF MANUFACTURING A LIGHTING BOLLARD ASSEMBLY

(75) Inventors: Paul D. Seff, Williamsburg, VA (US); Alston G. Brooks, Grafton, VA (US); Gregory S. Nailler, Providence Forge, VA (US)

(73) Assignee: Eaton Corporation, Cleveland, OH (US)

( * ) Notice: Subject to any disclaimer, the term of this patent is extended or adjusted under 35 U.S.C. 154(b) by 319 days.

(21) Appl. No.: 11/780,551

(22) Filed: Jul. 20, 2007

(65) Prior Publication Data

US 2009/0023354 A1 Jan. 22, 2009

(51) Int. Cl.
*H05K 3/30* (2006.01)

(52) U.S. Cl. ..... 29/832; 29/831; 29/854; 29/857; 29/876; 362/362; 362/431; 362/153.1; 362/363; 362/253

(58) Field of Classification Search ..... 362/362, 362/431, 153.1, 363, 253, 290, 296, 291, 362/302, 609, 342, 341, 329, 319, 298; 29/832, 29/831, 854, 857, 876; 174/54, 57, 58
See application file for complete search history.

(56) References Cited

U.S. PATENT DOCUMENTS

| | | | | | |
|---|---|---|---|---|---|
| 3,593,014 | A * | 7/1971 | Vesely | 362/291 |
| 4,774,648 | A * | 9/1988 | Kakuk et al. | 362/302 |
| 4,794,502 | A * | 12/1988 | Guggemos | 362/331 |
| 4,996,636 | A * | 2/1991 | Lovett | 362/431 |
| 5,414,607 | A * | 5/1995 | Harris et al. | 362/362 |
| D366,713 | S * | 1/1996 | Cornell et al. | D26/68 |
| 6,341,877 | B1 * | 1/2002 | Chong | 362/291 |
| 7,036,960 | B1 * | 5/2006 | Gretz | 362/354 |
| 7,182,547 | B1 * | 2/2007 | Leonhardt et al. | 404/9 |
| 2007/0279912 | A1 * | 12/2007 | Urquhart | 362/341 |

* cited by examiner

*Primary Examiner*—Marvin M Lateef
*Assistant Examiner*—Azm Parvez
(74) *Attorney, Agent, or Firm*—Martin J. Moran

(57) ABSTRACT

The present invention provides methods of manufacturing a bollard light assembly that provides a choice of light output by being size-adaptable depending on the choice of light output. The methods comprise, in pertinent part, selecting an elongated light and interposing a number of lens rings and light deflectors which correspond to the length of the selected elongated light. Also provided is a lighting bollard assembly manufactured according to the methods of the present invention.

24 Claims, 9 Drawing Sheets

METHOD OF MANUFACTURING A LIGHTING BOLLARD ASSEMBLY

BACKGROUND OF THE INVENTION

1. Field of the Invention

The present invention pertains generally to lighting fixtures and, more particularly, to a method of manufacturing a lighting bollard assembly that is adaptable to accept varying lengths of lights.

2. Background Information

Lighting bollards (or bollard lights) are so named because in shape they tend to resemble the bollards, i.e., posts, used at wharfs and around which mooring lines are fastened. Outdoor bollard lights are a sophisticated way to illuminate pathways and other areas of a landscape. The unobtrusive design offers a unique way to dress up the exterior of a home or commercial space through soft lighting without detracting from the architectural elements of a building's facade.

Traditional stacked louvered bollards are manufactured to provide a particular wattage of light within a particular louver stack atop the bollard in which the bollard is configured in a particular tubular shape. Thus, known bollard lights are manufactured as set structures that do not have the flexibility to adjust the configuration of the structures so as to accommodate varying lengths of light fixtures.

Such typical bollard lights are disclosed in U.S. Pat. Nos. 6,341,877 and 7,182,547, which disclose a bollard light with a diffuser rim retrofitted around the edge of a clear diffuser so as to emit a special light color effect; and a bollard post having a lamp resting atop the post, in which the lamp includes a spaced-apart louver stack, respectively.

SUMMARY OF THE INVENTION

It therefore would be advantageous to have a bollard light which is adaptable in structure so as to accept light bulbs of varying lengths and thus provide flexibility with respect to the choice of light output.

Accordingly, an object of the present invention is to provide a method of manufacturing a lighting bollard assembly that provides a choice of light output.

Another object of the present invention is to provide a method of manufacturing a lighting bollard assembly that is size-adaptable depending on the choice of light output.

A further object of the present invention is to provide a lighting bollard assembly produced according to the methods of the present invention.

These objectives are met by the embodiments of the present invention, which provide methods for manufacturing a lighting bollard assembly for a plurality of different elongated lights having different corresponding lengths.

In an aspect of the present invention, there is provided a method of manufacturing a lighting bollard assembly for a plurality of different elongated lights having different corresponding lengths, comprising mounting a circuit structured to power any one of the different elongated lights atop a base; mounting a first clamp plate atop the circuit and the base; selecting an elongated light from the different elongated lights and affixing the selected elongated light into a light socket; selecting a number of interposed lens rings and a number of light deflectors to correspond to the length of the selected elongated light; interposing the selected number of lens rings among the selected number of light deflectors, wherein each of the selected number of lens rings is inserted into a corresponding one of the selected number of light deflectors; mounting the selected number of interposed lens rings and the selected number of light deflectors atop the circuit; mounting a second clamp plate atop the selected number of interposed lens rings and the selected number of light deflectors; mounting a hood atop the second clamp plate; and connecting together the hood, the second clamp plate, the selected number of interposed lens rings, the selected number of light deflectors, the first clamp plate and the base.

The elongated lights may include, without limitation, fluorescent bulbs, each having a wattage of, for example, five, seven, nine or thirteen watts. When a five or seven watt fluorescent bulb is selected, three or four lens rings are interposed among two or three light deflectors, respectively. When a nine or thirteen watt fluorescent bulb is selected, five lens rings are interposed among four light deflectors.

In another aspect of the present invention, there is provided a lighting bollard assembly produced according to the methods of the present invention.

In another aspect of the present invention, there is provided a method of manufacturing a lighting bollard assembly for a plurality of different elongated lights having different corresponding lengths. The method comprises mounting a circuit structured to power any one of different elongated lights atop a base, in which the base is comprised of a mounting base and an upright tube, the upright tube being of a predetermined length, such as, without limitation, two feet long, four feet long, six feet long or eight feet long. A first clamp plate then is mounted atop the circuit and the upright tube, the first clamp plate having a plurality of openings therethrough. Conductors from the circuit are inserted through at least one of the openings of the first clamp plate, into a lamp cup having a first side and a second side and a plurality of openings therethrough, and into a light socket. An elongated light from the different elongated lights is selected and affixed into the light socket. The lamp cup is mounted atop the first clamp plate. A number of interposed lens rings and a number of light deflectors are selected which correspond to the length of the selected elongated light, in which each of the selected number of lens rings is inserted into a corresponding one of the selected number of light deflectors. The selected number of interposed lens rings and selected number of light deflectors are mounted atop the lamp cup. A second clamp plate having a plurality of openings therethrough is mounted atop the adjusted number of interposed lens rings and light deflectors. A hood having a plurality of openings therethrough is mounted atop the second clamp plate. The hood, the second clamp plate, the selected number of interposed lens rings and selected number of light deflectors, the lamp cup, the first clamp plate and the upright tube and the mounting base then are connected together.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1B:
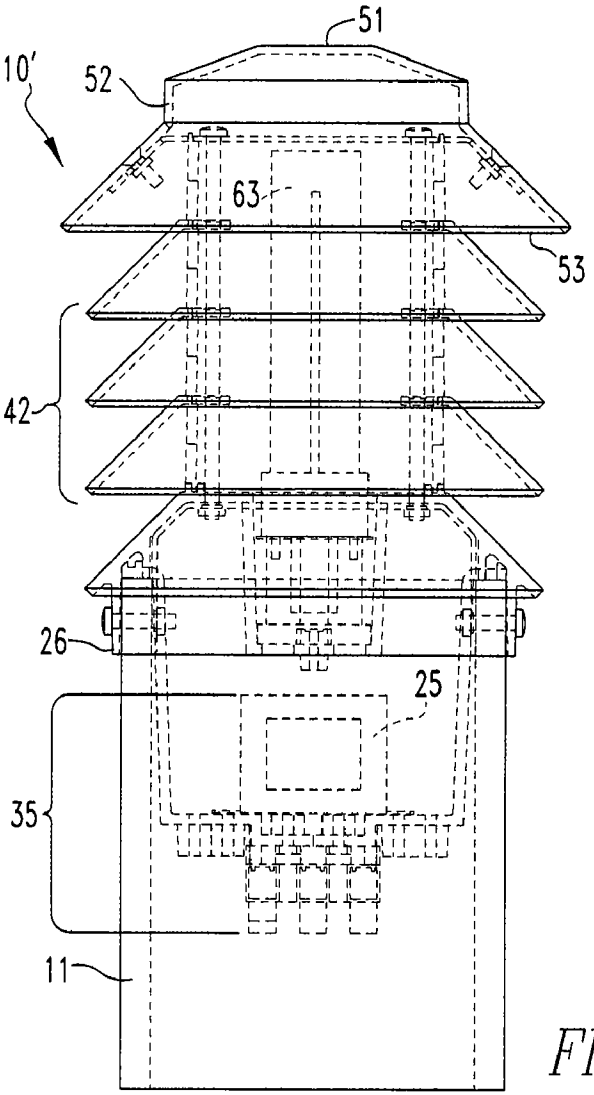
FIG. 1 is an elevational view of four example lighting bollard assemblies, in which (A) is a five watt lighting bollard assembly, (B) is a seven watt lighting bollard assembly, (C) is a nine watt lighting bollard assembly and (D) is a thirteen watt lighting bollard assembly in accordance with embodiments of the invention.
Figure 1A:
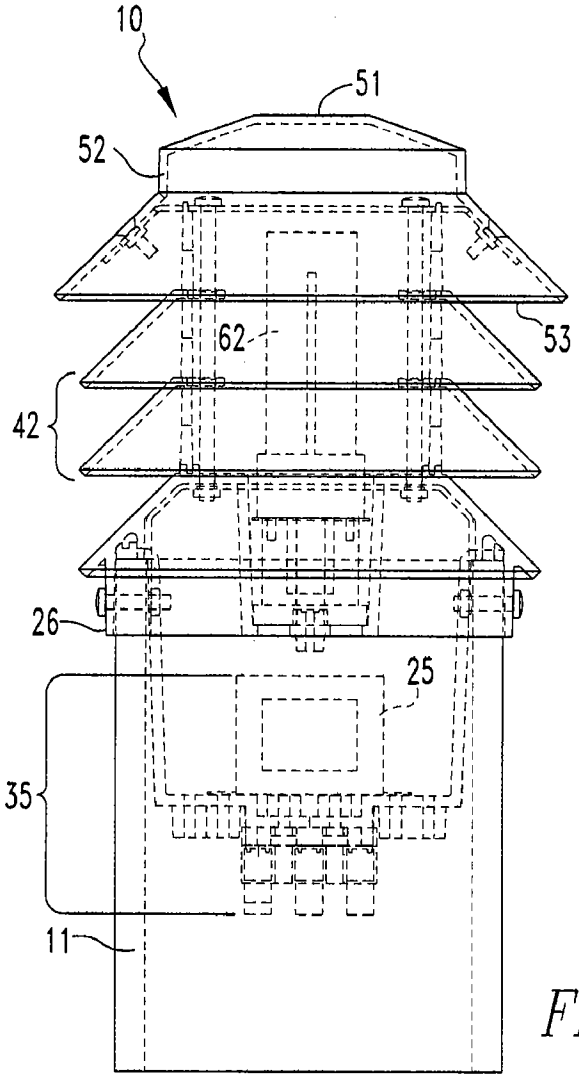

A complete understanding of the present invention will be obtained from the following description taken in connection with the accompanying drawing figures, wherein like reference characters identify like parts throughout.

Directional phrases used herein, such as, for example, "upper" and "lower" and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and washers and nuts.

As employed herein, the term "connector" refers to any suitable electrical connection or connection mechanism capable of carrying an electrical current therein.

As employed herein, the statement that two or more parts are "connected" or "coupled" together shall mean that the parts are joined together either directly or joined through one or more intermediate parts. Further, as employed herein, the statement that the two or more parts are "attached" shall mean that the parts are joined together directly.

The invention is described in association with a method for manufacturing a lighting bollard assembly for a plurality of different elongated lights having different corresponding lengths.

Figure 1D:
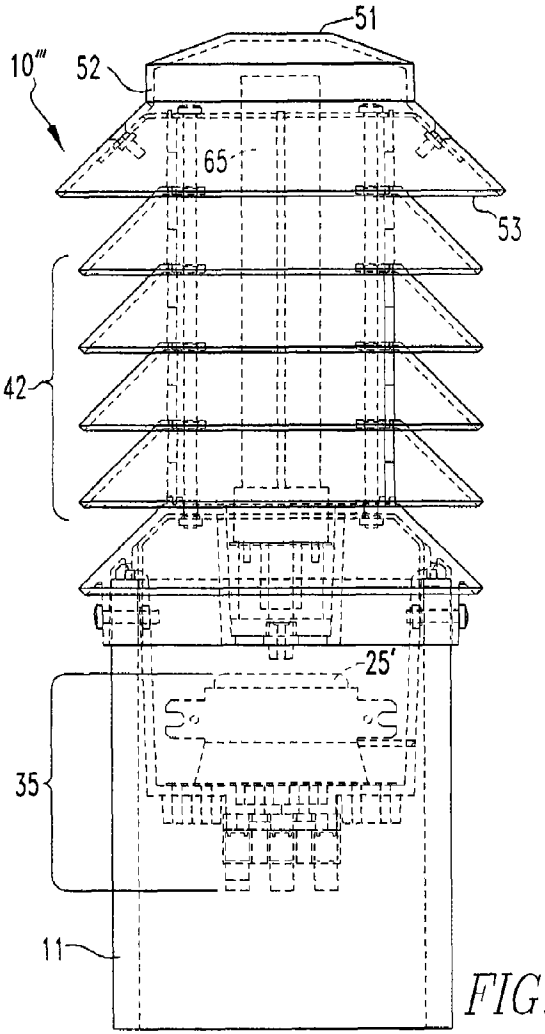
Figure 1C:
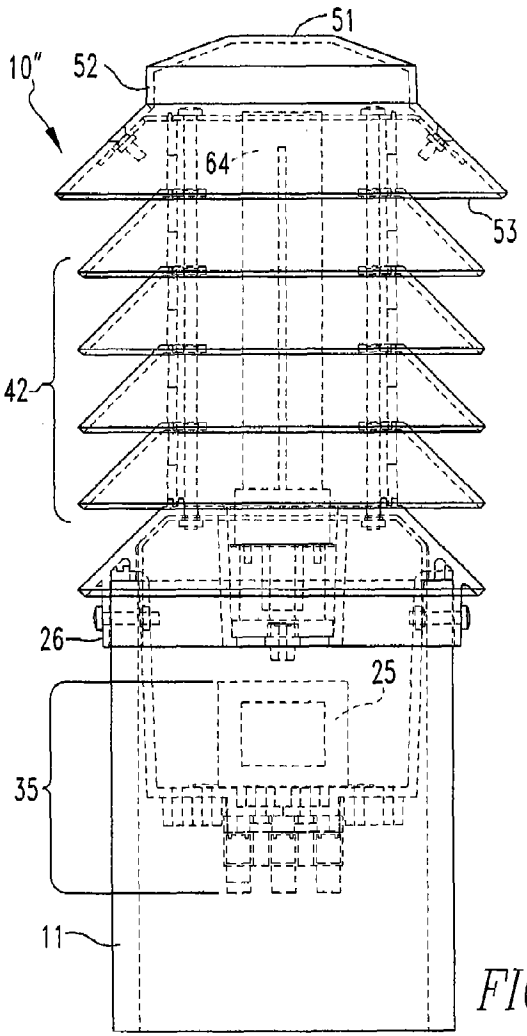
Figure 2:
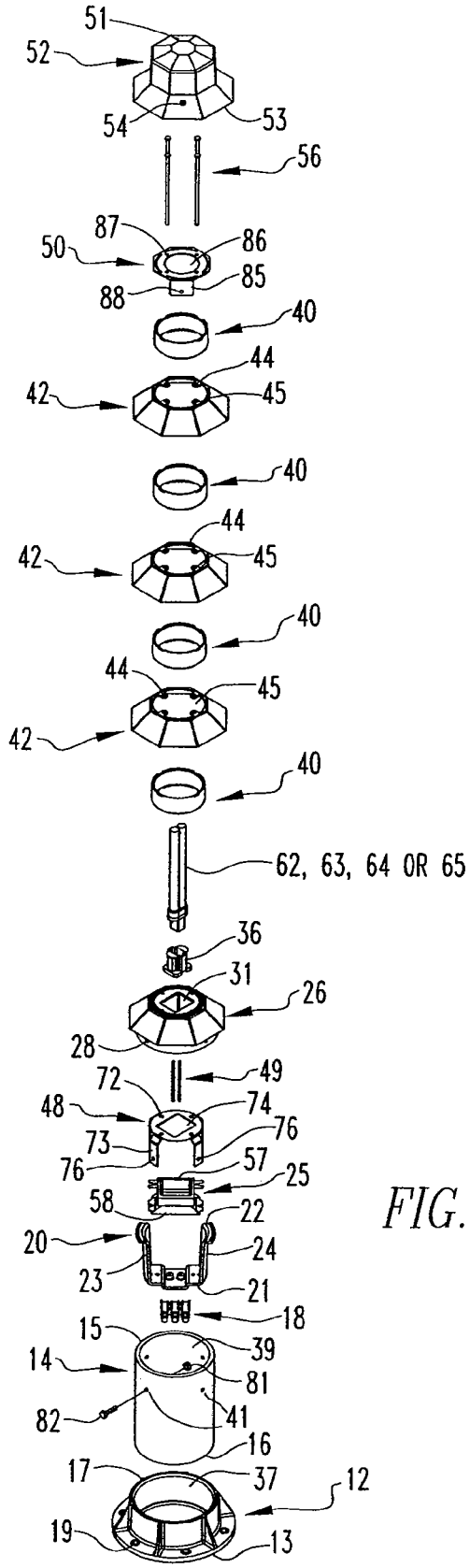
FIG. 2 is an exploded isometric view of the components of a lighting bollard assembly, in accordance with embodiments of the invention.

Referring to FIGS. 1 and 2, the lighting bollard assemblies 10, 10', 10", 10'" (FIG. 1) is comprised of a base 11 (FIG. 1) in which the base 11 is comprised of a mounting base 12 (FIG. 2) and an upright tube 14 (FIG. 2); a circuit 35 (FIG. 1), in which the circuit 35 is comprised of a terminal block 18 (FIG. 2), a transition strap 20 (FIG. 2) and a light ballast 25, 25' (FIG. 1); a first clamp plate 48 (FIG. 2), a lamp cup 26, a light socket 36 (FIG. 2), a plurality of different elongated lights 62, 64, 66 (FIG. 1) with different lengths; a plurality of lens rings 40 (FIG. 2); a plurality of light deflectors 42; a second clamp plate 50 (FIG. 2); a plurality of fasteners 56 (FIG. 2); and a hood 52.

The different elongated lights 62, 63, 64, 65 can include, without limitation, fluorescent bulbs. The different fluorescent bulbs each can have wattages such as, without limitation, five watts (light 62), seven watts (light 63), nine watts (light 64) or thirteen watts (light 65).

Figure 3:
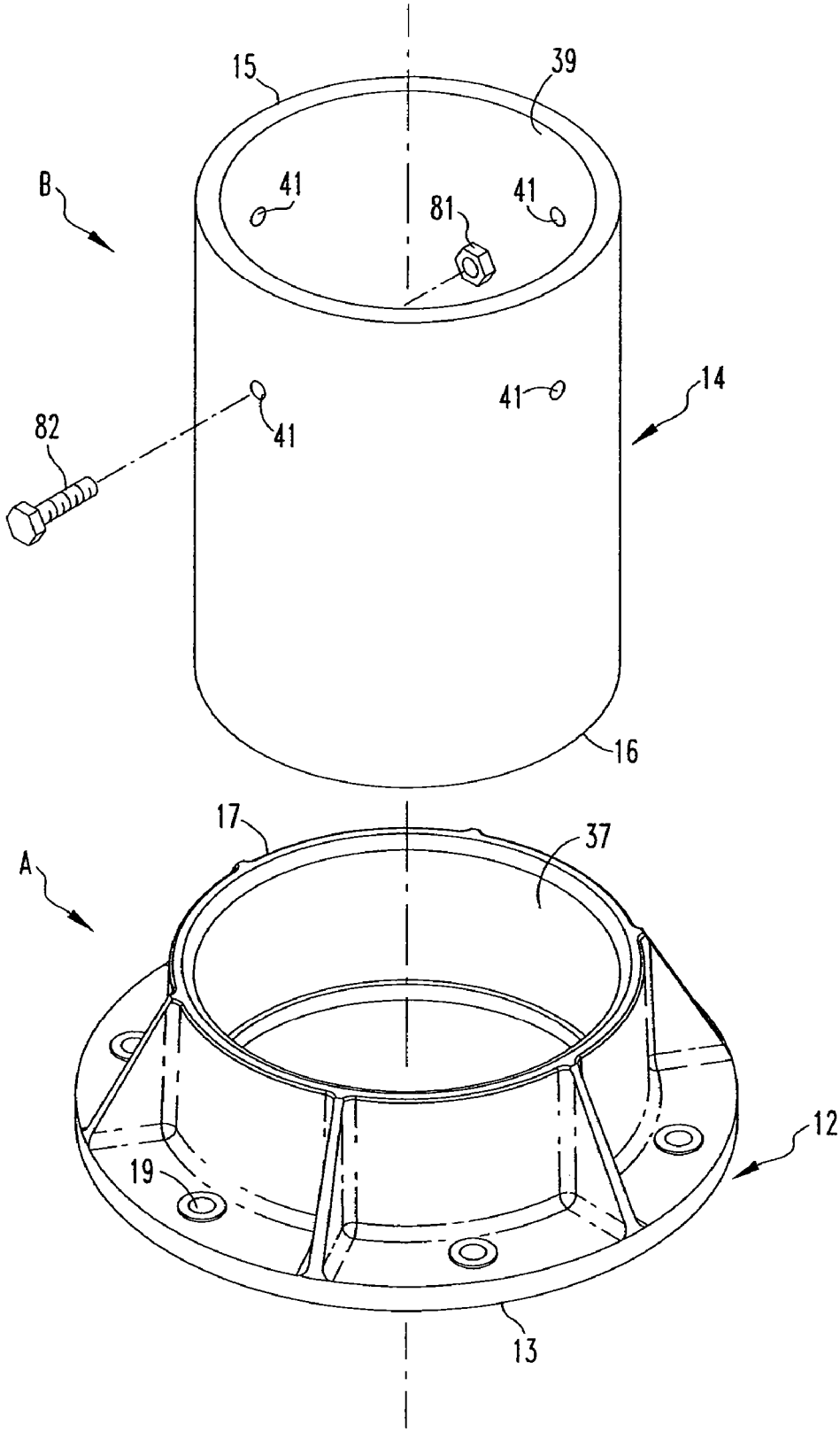
FIG. 3 is an exploded isometric view of two components of the bollard light assemblies of FIG. 2: (A) a mounting base, and (B) an upright tube.

Referring to FIG. 3, the mounting base 12 has a lower end 13 with a plurality of openings 19 therethrough and an upper end 17 with a center opening 37 therein. The upright tube 14 has a lower end 16 and an upper end 15 with a center opening 39 therein.

Figure 4:
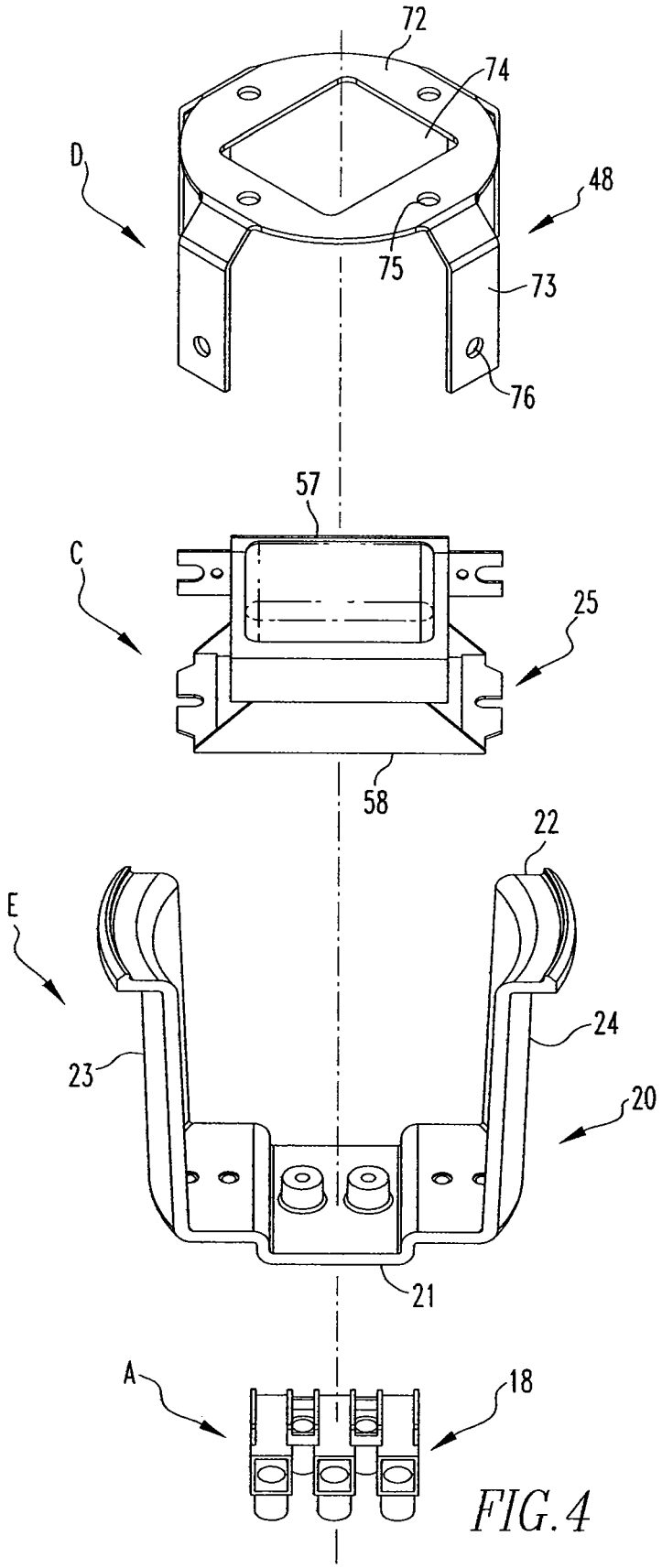
FIG. 4 is an exploded isometric view of four components of the bollard light assemblies of FIG. 2: (A) a terminal block, (B) a transition strap, (C) a light ballast, and (D) a first clamp plate.

Referring to FIG. 4, the transition strap 20 has a lower end 21, an upper end 22, a first side 23 and a second side 24. The light ballast 25 has an upper end 57 and a lower end 58. The first clamp plate has an upper end 72 which has an opening 74 therethrough and four peripheral openings therein, and four legs 73, in which each leg 73 has an opening therein 76 (two openings are shown).

Figure 5:
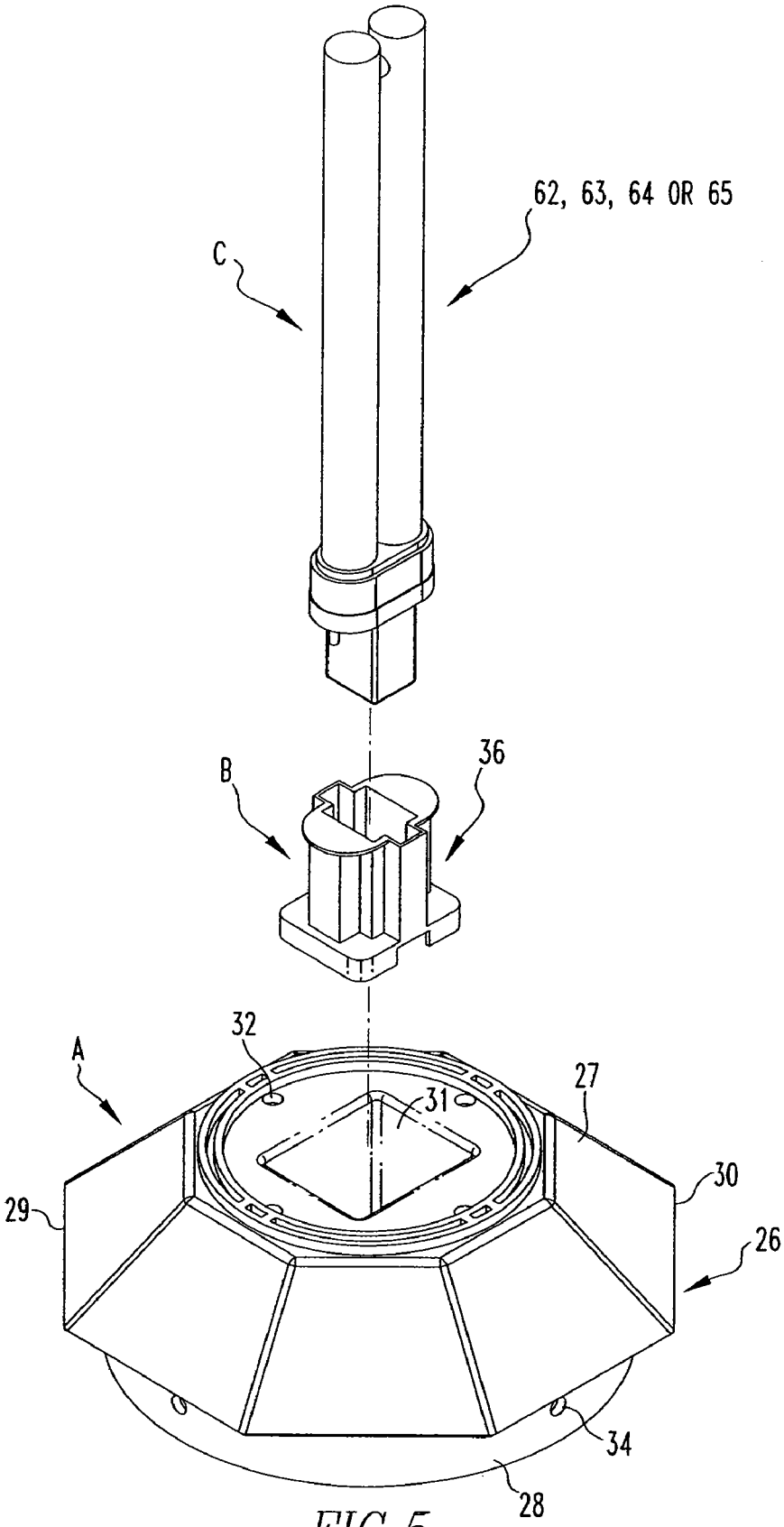
FIG. 5 is an exploded isometric view of three components of one of the bollard light assemblies of FIG. 2: (A) a lamp cup, (B) a light socket, and (C) a fluorescent bulb.

Referring to FIG. 5, the lamp cup 26 has an upper end 27, a lower end 28, a first side 29, a second side 30, a center opening 31, four peripheral openings 32 at the upper end 27 and four openings 34 (two openings are shown) at the lower end 28.

Figure 6:
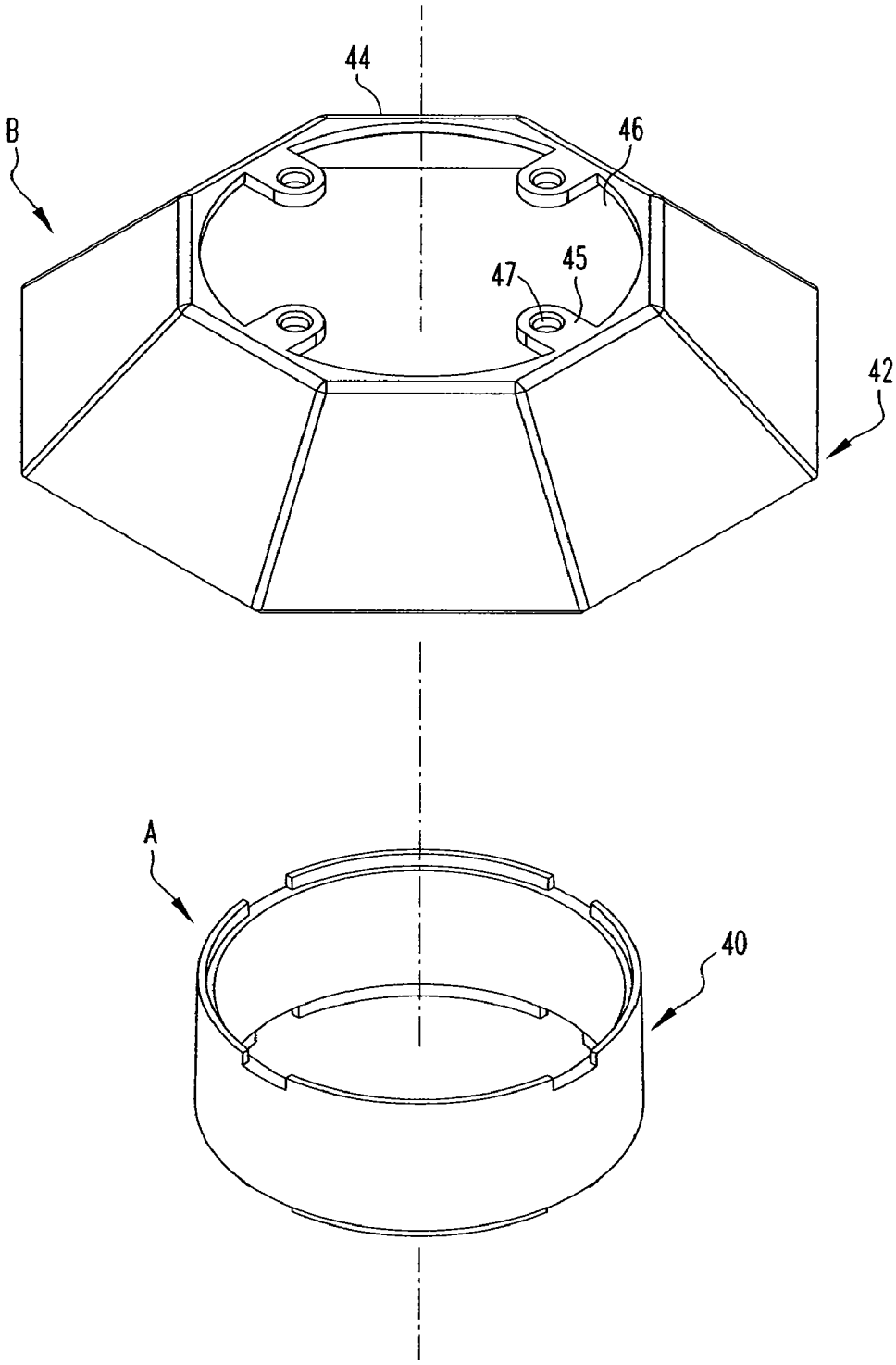
FIG. 6 is an exploded isometric view of two components of the bollard light assemblies of FIG. 2: (A) a tube ring, and (B) a light deflector.

Referring to FIG. 6, the light deflector 42 has an upper end 44 having four ears 45 therein and a center opening 46 therethrough. Each of the ears 45 has an opening 47 therein.

Figure 7:
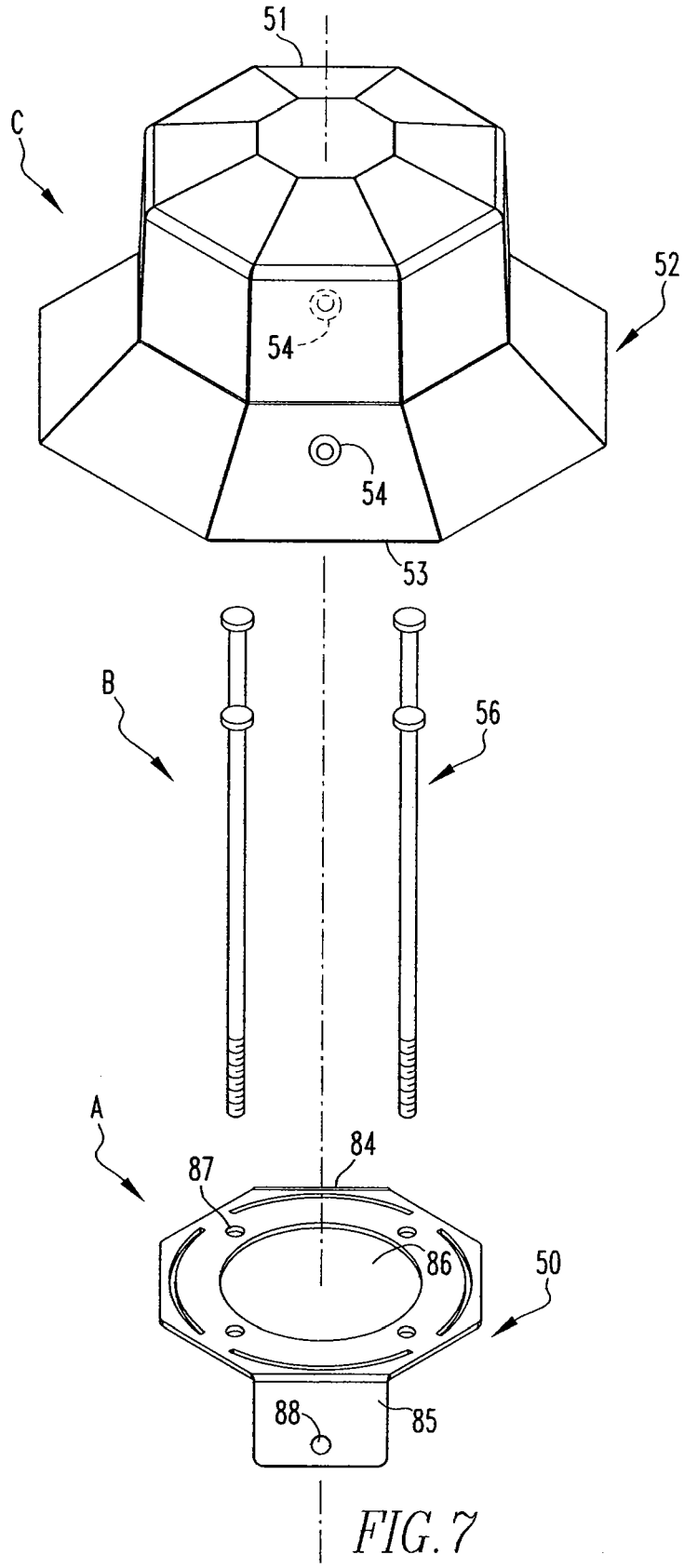
FIG. 7 is an exploded isometric view of three components of the bollard light assemblies of FIG. 2: (A) a second clamp plate, (B) a set of four fasteners, and (C) a hood.

Referring to FIG. 7, the hood 52 has an upper end 51 and a lower end 53 having four openings 54 (one opening is shown) therein. The second clamp plate 50 has an upper end 84 having a center opening 86 therethrough and four peripheral openings 87 therein and two legs 85 (one leg is shown), each leg 85 having an opening therein 88.

Referring again to FIGS. 1 and 2, embodiments of the present invention provide a method of manufacturing a lighting bollard assembly 10, 10', 10", 10'" (FIG. 1), comprising mounting a circuit 35 (FIG. 1) structured to power any one of the different elongated lights 62, 63, 64, 65 (FIG. 1) atop a base 11 (FIG. 1); mounting a first clamp plate 48 (FIG. 2) atop the circuit 35 and the base 11; selecting an elongated light 62, 63, 64 or 65 from the different elongated lights 62, 63, 64, 65, affixing the selected elongated light 62, 63, 64 or 65 into a light socket 36 and inserting the light socket 36 into the center opening 31 in the upper end 27 of the lamp cup 26; selecting a number of interposed lens rings 40 (FIG. 2) and a number of light deflectors 42 to correspond to the length of the selected elongated light 62, 63, 64 or 65; interposing the selected number of lens rings 40 among the selected number of light deflectors 42, wherein each of the selected number of lens rings 40 is inserted into a corresponding one of the selected number of light deflectors 42; mounting the selected number of interposed lens rings 40 and the selected number of light deflectors 42 atop the circuit 35, the first clamp plate 48 and the lamp cup 26; mounting a second clamp plate 50 (FIG. 2) atop the selected number of interposed lens rings 40 and the selected number of light deflectors 42; mounting a hood 52 atop the second clamp plate 50; and connecting together the hood 52, the second clamp plate 50, the selected number of interposed lens rings 40, the selected number of light deflectors 42, the lamp cup 26, the first clamp plate 48 and the base 11.

Referring to FIGS. 2 and 3, the method further comprises inserting the lower end 16 of the upright tube 14 (FIG. 3B) into the opening 37 in the upper end 17 of the mounting base 12 (FIG. 3A).

Referring to FIGS. 2 and 4, the method further comprises affixing the terminal block 18 (FIG. 4A) to the lower end 21 of the transition strap 20 (FIG. 4B) and affixing the lower end 58 of the light ballast (FIG. 4C) to the upper end 22 of the transition strap 20.

Referring to FIGS. 2-5, the method further comprises inserting the lower end 28 of the lamp cup 26 (FIG. 5A) into the transition strap 20 (FIG. 4B) by inserting the first side 29 of the lamp cup 26 into the first side 23 of the transition strap 20 and inserting the second side 30 of the lamp cup 26 into the second side 24 of the transition strap 20. Conductors 49 (FIG. 2), such as, without limitation, insulated electric wires, are inserted from the terminal block 18, through the transition strap 20, the light ballast 25, the center opening 74 in the first clamp plate 48, the center opening 31 of the lamp cup 26, and into the light socket 36 (FIG. 5B). The lower end 21 of the transition strap 20 is inserted into the opening 39 in the upper end 15 of the upright tube 14. Each of the legs 73 of the first clamp plate 48 is inserted into the opening 39 in the upper end 15 of the upright tube 14.

Referring to FIG. 7, the method further comprises attaching together the hood 52 (FIG. 7C) and the second clamp plate 50 (FIG. 7A) by mounting the hood 52 atop the second clamp plate 50; aligning the two openings 54 (only one opening is shown) in the lower end 53 of the hood 52 with a corresponding one of the two openings 88 (only one opening is shown) in the two legs 85 of the second clamp plate 50; employing a press nut 81 at each of the openings 88 in each of the legs 85 of the second clamp plate 50; and inserting a bolt 82 in each of the openings 54 in the lower end 53 of the hood 52, each of the bolts screwably attaching into a corresponding one of the nuts in the legs of the second clamp plate 50.

Referring to FIGS. 4-7, the method further comprises connecting together the second clamp plate 50, the selected number of interposed lens rings 40 (FIG. 6A) and the selected number of light deflectors 42 (FIG. 6B), the lamp cup 26 and the first clamp plate 48 by inserting a fastener 56 (FIG. 7B) into one of four peripheral openings 87 in the upper end 84 of the second clamp plate 50, into a corresponding one of the four openings 47 in the four ears 45 of the selected number of light deflectors 42, into a corresponding one of four peripheral openings 32 in the upper end 27 of the lamp cup 26, and into a corresponding one of the four peripheral openings 75 in the upper end 72 of the first clamp plate 48.

Referring to FIGS. 3-5, the method further comprises attaching the lamp cup 26 and the first clamp plate 48 to the upper end 15 of the upright tube 14 by placing four openings 41 in the upright tube 14, inserting the four legs 73 of the first clamp plate 48 into the upright tube 14, mounting the lamp cup 26 atop the first clamp plate 48, aligning the four openings 34 (two openings are shown) in the lower end 28 of the lamp cup 26 with the four openings 76 (two openings are shown) in the four legs 73 of the first clamp plate 48 and with the four openings 41 in the upright tube 14, inserting a press nut 81 into each of the openings 76 in the legs 73 of the first clamp plate 48, and inserting a bolt 82 into each of the openings 34 in the lower end 28 of the lamp cup 26, into a corresponding one of the openings in the upright tube 14, and into a corresponding one of the openings 76 in the legs 73 of the first clamp plate 48, each of the bolts screwably attaching into a corresponding one of the press nuts in the openings 76 of the legs 73 of the first clamp plate 48.

Figure 8:
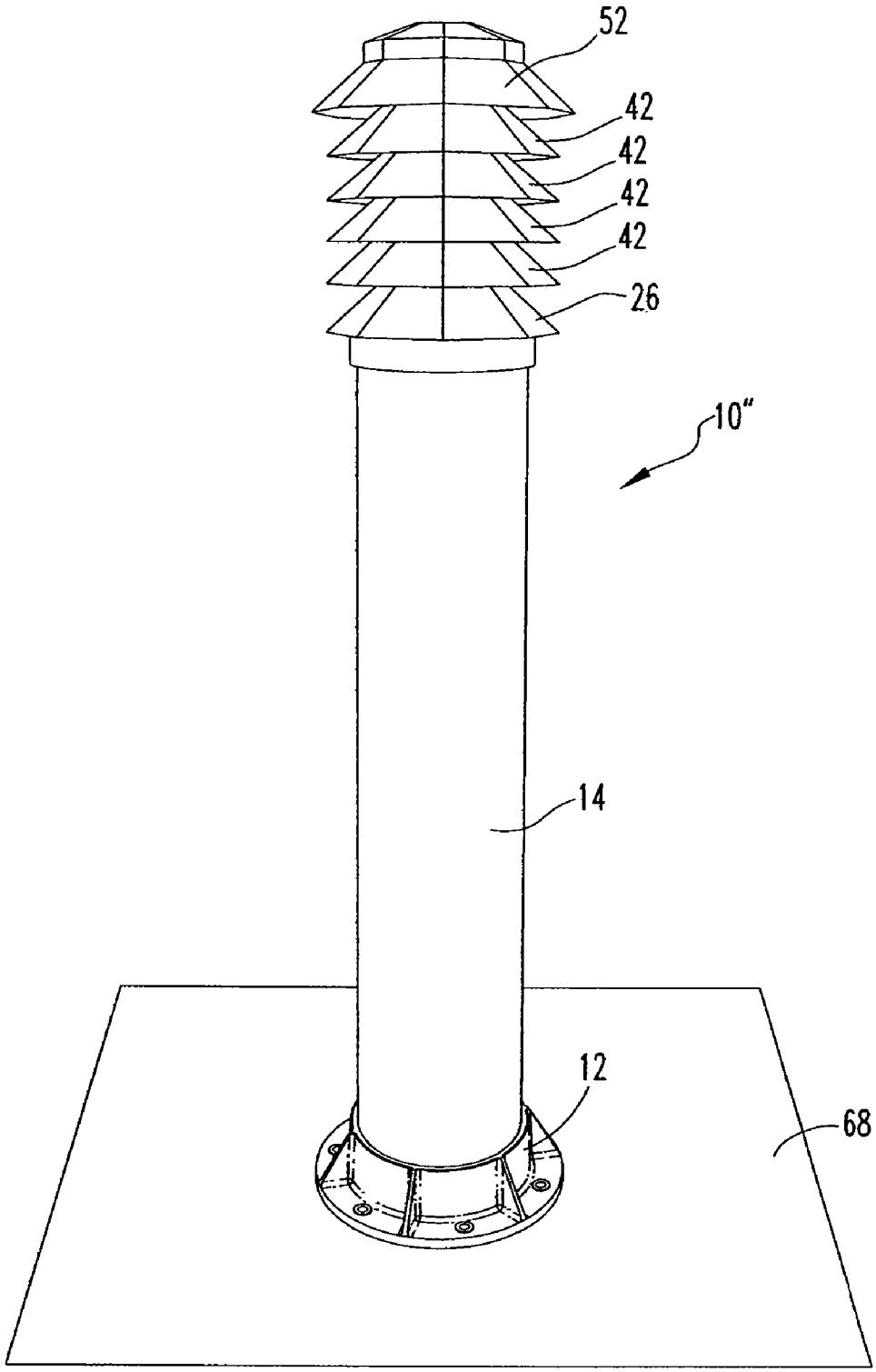
FIG. 8 is an isometric view of an example thirteen watt lighting bollard assembly, in accordance with embodiments of the invention.

Referring to FIGS. 2 and 8, the method further comprises attaching the lower end 13 of the mounting base 12 to a surface 68 by inserting bolts 82 into each of the four openings 19 in the lower end 13 of the mounting base 12 and fixedly attaching each of the bolts to the surface 68. The surface may include, without limitation, wood, concrete or asphalt.

Referring to FIGS. 1, 2 and 5, the method further comprises interposing three lens rings 40 (FIG. 2) and two light deflectors 42 when a five watt fluorescent bulb 62 (FIG. 1A) is selected for use in the bollard light assembly 10 (FIG. 1A); interposing four lens rings 40 (FIG. 2) and three light deflectors 42 when a seven watt fluorescent bulb 63 (FIG. 1B) is selected for use in the bollard light assembly 10' (FIG. 1B); interposing five lens rings 40 (FIG. 2) and four light deflectors 42 when a nine watt fluorescent bulb 64 (FIG. 1C) is selected for use in the bollard light assembly 10" (FIG. 1C); and interposing five lens rings 40 (FIG. 2) and four light deflectors 42 when a thirteen watt fluorescent bulb 65 (FIG. 1D) is selected for use in the bollard light assembly 10'" (FIG. 1D)

In another embodiment of the present invention, there is provided a lighting bollard assembly 10, 10', 10", 10'" (FIG. 1) manufactured according to the methods of the present invention.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of manufacturing a lighting bollard assembly for a plurality of different elongated lights having different corresponding lengths, said method comprising:

mounting a circuit structured to power any one of said different elongated lights atop a base;

mounting a first clamp plate atop said circuit and said base;

selecting an elongated light from said different elongated lights and affixing said selected elongated light into a light socket;

selecting a number of interposed lens rings and a number of light deflectors to correspond to the length of said selected elongated light;

interposing said selected number of lens rings among said selected number of light deflectors, wherein each of said selected number of lens rings is inserted into a corresponding one of said selected number of light deflectors;

mounting said selected number of interposed lens rings and said selected number of light deflectors atop said circuit;

mounting a second clamp plate atop said selected number of interposed lens rings and said selected number of light deflectors;

mounting a hood atop said second clamp plate; and connecting together said hood, said second clamp plate, said selected number of interposed lens rings, said selected number of light deflectors and said base.

2. The method according to claim 1, further comprising employing said base comprised of a mounting base having an upper end and lower end, said lower end having a plurality of openings therein, and an upright tube, said upright tube having an upper end and a lower end, said lower end of said upright tube being affixed atop said mounting base, wherein said upright tube has a variable length.

3. The method according to claim 1, further comprising employing a lamp cup comprised of an upper end, a lower end, a first side and a second side, said upper end having a center opening therethrough and four peripheral openings therethrough, said lower end having four openings therethrough, and inserting said lower end of said lamp cup into said circuit.

4. The method according to claim 1, further comprising employing said first clamp plate, said first clamp plate comprised of an upper end and four legs, said upper end having a center opening therethrough and four peripheral openings therein, each of said four legs having an opening therein.

5. The method according to claim 4, further comprising inserting conductors from said circuit through said center opening in said first clamp plate, through said center opening in said lamp cup, and into said light socket.

6. The method according to claim 1, further comprising employing said circuit comprised of a terminal block, a transition strap having a first side and a second side and an upper end and a lower end, a light ballast having an upper end and a lower end, and said light socket; affixing said terminal block to said lower end of said transition strap; affixing said lower end of said light ballast to said upper end of said transition strap; and inserting said light socket into said center opening in said upper end of said lamp cup.

7. The method according to claim 6, further comprising inserting said first side of said lamp cup into said first side of said transition strap and inserting said second side of said lamp cup into said second side of said transition strap.

8. The method according to claim 7, further comprising inserting said lower end of said transition strap into said opening in said upper end of said upright tube.

9. The method according to claim 8, further comprising inserting each of said legs of said first clamp plate into said opening of said upper end of said upright tube.

10. The method according to claim 1, further comprising employing said selected number of light deflectors, each of said selected number of light deflectors comprised of an upper end with four ears thereon and a center opening therethrough, each of said ears having an opening therethrough.

11. The method according to claim 1, further comprising employing said second clamp plate, said second clamp plate comprised of an upper end and two legs, said upper end having a center opening therethrough and four peripheral openings therein, each of said legs having an opening therein, wherein said legs are 180 degrees apart.

12. The method according to claim 11, further comprising employing said hood, said hood having an upper end and a lower end, said lower end having two openings therein, wherein said two openings are 180 degrees apart.

13. The method according to claim 12, further comprising attaching together said hood and said second clamp plate by mounting said hood atop said second clamp plate; aligning said two openings in said lower end of said hood with a corresponding one of two openings in said two legs of said second clamp plate, inserting a nut into each of said openings in each of said legs of said second clamp plate, and inserting a bolt in each of said openings in said lower end of said hood, each of said bolts screwably attaching into a corresponding one of said nuts in said legs of said second clamp plate.

14. The method according to claim 13, further comprising connecting together said second clamp plate, said selected number of interposed lens rings and said selected number of light deflectors, said lamp cup and said first clamp plate by inserting a fastener into each one of said four peripheral openings in said upper end of said second clamp plate, into a corresponding one of said four openings in said four ears of said selected number of light deflectors, into a corresponding one of four peripheral openings in said upper end of said lamp cup, and into a corresponding one of said four peripheral openings in said upper end of said first clamp plate.

15. The method according to claim 14, further comprising attaching said lamp cup and said first clamp plate to said upper end of said upright tube by placing four openings in said upright tube, inserting said legs of said first clamp plate into said upright tube, mounting said lamp cup atop said first clamp plate, aligning said four openings in said lower end of said lamp cup with said four openings in said legs of said first clamp plate and with said four openings in said upright tube, inserting a nut into each of said openings in said legs of said first clamp plate, and inserting a bolt into each of said openings in said lower end of said lamp cup, into a corresponding one of said openings in said upright tube, and into a corresponding one of said openings in said legs of said first clamp plate, each of said bolts screwably attaching into a corresponding one of said nuts in said openings in said legs of said first clamp plate.

16. The method according to claim 2, further comprising attaching said lower end of said mounting base to a surface by inserting bolts into each of said four openings in said lower end of said mounting base and fixedly attaching each of said bolts to said surface.

17. The method according to claim 1, further comprising employing said elongated lights, said elongated lights comprising fluorescent bulbs.

18. The method according to claim 17, further comprising employing said fluorescent bulb having a wattage selected from the group consisting of five watts, seven watts, nine watts and thirteen watts.

19. The method according to claim 18, further comprising selecting a five watt fluorescent bulb and selecting the number of interposed lens rings and the number of light deflectors to be three lens rings interposed among two light deflectors.

20. The method according to claim 18, further comprising selecting a seven watt fluorescent bulb and selecting the number of interposed lens rings and the number of light deflectors to be four lens rings interposed among three light deflectors.

21. The method according to claim 18, further comprising selecting a nine watt fluorescent bulb and selecting the number of interposed lens rings and the number of light deflectors to be five lens rings interposed among four light deflectors.

22. The method according to claim 18, further comprising selecting a thirteen watt fluorescent bulb and selecting the number of interposed lens rings and the number of light deflectors to be five lens rings interposed among four light deflectors.

23. A method of manufacturing a lighting bollard assembly for a plurality of different elongated lights having different corresponding lengths, said method comprising:

mounting a circuit structured to power any one of said different elongated lights atop a base, said base comprised of a mounting base and an upright tube, wherein said upright tube has a predetermined length;

mounting a first clamp plate atop said circuit and said upright tube, said first clamp plate having a plurality of openings therethrough;

inserting conductors from said circuit through at least one of the openings of said first clamp plate, into a lamp cup having a first side and a second side and a plurality of openings therethrough, and into a light socket;

selecting an elongated light from said different elongated lights and affixing said selected elongated light into said light socket;

mounting said lamp cup atop said first clamp plate;

selecting a number of interposed lens rings and a number of light deflectors to correspond to the length of said selected elongated light, wherein each of said selected number of lens rings is inserted into a corresponding one of said selected number of light deflectors;

mounting said selected number of interposed lens rings and said selected number of light deflectors atop said lamp cup;

mounting a second clamp plate having a plurality of openings therethrough atop said adjusted number of interposed lens rings and light deflectors;

mounting a hood having a plurality of openings therethrough atop said second clamp plate; and connecting together said hood, said second clamp plate, said selected number of interposed lens rings and said selected number of light deflectors, said lamp cup, said first clamp plate, said upright tube and said mounting base.

24. The method according to claim 23, further comprising selecting a five watt fluorescent bulb and selecting the number of interposed lens rings and the number of light deflectors to be three lens rings interposed among two light deflectors, or selecting a seven watt fluorescent bulb and selecting the number of interposed lens rings and the number of light deflectors to be four lens rings interposed among three light deflectors, selecting a nine watt fluorescent bulb and selecting the number of interposed lens rings and the number of light deflectors to be five lens rings interposed among four light deflectors or selecting a thirteen watt fluorescent bulb and selecting the number of interposed lens rings and the number of light deflectors to be five lens rings interposed among four light deflectors.

* * * * *